US005279370A

United States Patent [19]

Brandell et al.

[11] Patent Number: 5,279,370

[45] Date of Patent: Jan. 18, 1994

[54] MECHANICAL CEMENTING PACKER COLLAR

[75] Inventors: John T. Brandell; Alan B. Duell, both of Duncan, Okla.

[73] Assignee: Halliburton Company, Duncan, Okla.

[21] Appl. No.: 934,151

[22] Filed: Aug. 21, 1992

[51] Int. Cl.[5] ..... E21B 33/12

[52] U.S. Cl. ..... 166/386; 166/184; 166/242

[58] Field of Search ..... 166/184, 186, 191, 242, 166/278, 285, 289, 291, 386, 387

[56] References Cited

U.S. PATENT DOCUMENTS

| | | | |
|---|---|---|---|
| 2,169,568 | 8/1939 | Morrisett | 166/1 |
| 2,435,106 | 1/1948 | Pitts | 166/1 |
| 3,223,160 | 12/1965 | Baker | 166/27 |
| 3,669,190 | 6/1972 | Sizer et al. | 166/387 |
| 3,768,556 | 10/1973 | Baker | 166/154 |
| 3,768,562 | 10/1973 | Baker | 166/289 |
| 3,811,500 | 5/1974 | Morrisett et al. | 166/154 |
| 3,948,322 | 4/1976 | Baker | 166/289 |
| 4,246,968 | 1/1981 | Jessup et al. | 166/334 |
| 4,286,658 | 9/1981 | Baker et al. | 166/289 X |
| 4,334,582 | 6/1982 | Baker et al. | 166/289 X |
| 4,421,165 | 12/1983 | Szarka | 166/151 |
| 4,858,687 | 8/1989 | Watson et al. | 166/153 |
| 4,917,188 | 4/1990 | Fitzpatrick, Jr. | 166/278 X |
| 4,966,236 | 10/1990 | Braddick | 166/291 |
| 5,024,273 | 6/1991 | Coone et al. | 166/289 |
| 5,038,862 | 8/1991 | Giroux et al. | 166/289 |
| 5,109,925 | 5/1992 | Stepp et al. | 166/184 |
| 5,117,910 | 6/1992 | Brandell et al. | 166/291 |

OTHER PUBLICATIONS

Baker Oil Tools 1978–79 Catalog showing Model G and Model J cementers.

Suman, Jr. and Ellis, "Cementing Oil and Gas Wells" World Oil 1977, pp. 41–49.

Halliburton Multiple Stage Mechanical Packer Collar advertisement.

Halliburton Multiple Stage Packer Cementing Collar advertisement.

Gemoco Eliminator Stage Tool with Packoff advertisement.

Arrow Oil Tools, Inc. Multiple-Stage Packer Collar 211 advertisement.

*Primary Examiner*—Ramon S. Britts
*Assistant Examiner*—Frank S. Tsay
*Attorney, Agent, or Firm*—James R. Duzan; Shawn Hunter

[57] ABSTRACT

An improved cementing tool, and more particularly an improved stage packer collar, having a tubular housing with an inner passage defined longitudinally therethrough and having a radially outer surface. The housing also has a cementing port and a longitudinal slot, both of which are disposed through a wall thereof. An outer closure sleeve is slidably received about the outer surface of the housing and is movable relative to the housing between an open position wherein the cementing port is not covered by the closure sleeve and a closed position wherein the cementing port is closed by the closure sleeve. An inner operating sleeve is slidably received in the inner passage of the housing and slidable between a first and second position relative to the housing. A mechanical interlocking means extends through the slot and is operably associated with both the operating sleeve and the closure sleeve for mechanically transferring a closing force from the operating sleeve to the closure sleeve and thereby moving the closure sleeve to its closed position as the operating sleeve moves from its first position to its second position. The cementing tool also includes a packer element for sealing the annular space below the cementing port between the casing and the borehole or between the casing and an outer string of casing. A means is also provided for setting the packer element in order to seal the annular space. Internal components of the cementing tool may be drilled out of the housing after cementing operations are completed thus leaving a smooth bore through the cementing tool through which other equipment can be run.

15 Claims, 12 Drawing Sheets

MECHANICAL CEMENTING PACKER COLLAR

BACKGROUND OF THE INVENTION

1. Field of the Invention

The present invention relates generally to sliding sleeve cementing tools constructed for placement in a well casing, and more particularly to an improved stage cementing packer collar used for cementing casing in oil and gas wells.

2. Description of the Prior Art

In the drilling of deep wells, it is often desirable to cement the casing in the well bore in separate stages, beginning at the bottom of the well and working upward. Cementing the casing in separate stages assures less contamination throughout the zones to be cemented and reduces the possibility of lost circulation due to excessive hydrostatic pressure.

This process is achieved by placing cementing tools, which are primarily valved ports, in the casing or between joints of casing at one or more locations in the well bore, flowing cement through the bottom of the casing, up the annulus to the lowest cementing tool, closing off the bottom, opening the cementing tool, and then flowing cement through the cementing tool up the annulus to the next upper stage and repeating this process until all stages of the well are cemented.

Cementing tools used for multi-stage cementing usually have two internal sleeves, both of which are usually shear-pinned initially in an upper position, closing the cementing ports in the tool. To open the cementing ports a plug is dropped or displaced down the casing and seated on the lower sleeve. Fluid pressure is then increased in the casing until sufficient force is developed on the plug and sleeve to shear the shear pins and move the lower sleeve to the position uncovering the cementing ports. Cement is then pumped down the casing and out the ports into the annulus. When the predetermined desired amount of cement has been displaced into the annulus another plug is placed in the casing behind the cement and displaced down the casing to seat on the upper sleeve. The pressure is increased on the second plug until the shear pins holding it are severed and the upper sleeve is moved down to close the cementing ports, thereby terminating that particular stage of the cement job.

Multistage cementing tools may also include a packet element for sealing the annular space between the casing, which the cementing tool is a part of, and the borehole or between the casing and another string of casing. Multistage cementing tools containing a packer element are commonly referred to as stage cementing packer collars. The packer element of a stage cementing packer is designed to support the cement displaced through the cementing ports of the stage cementing packer while protecting formations below the packer collar from the hydrostatic pressure of the cement. In addition, the packer element is designed to seal the annular space against upward migration of fluids from formations beneath the packer collar.

The present invention relates to an improved stage cementing packer collar. The improved stage cementing packer collar of the present invention has several improvements over previous stage cementing packer collars. These improvements include: (1) shorter length; (2) a single piece housing as opposed to a two or three piece housing with welds; (3) the housing has a smaller outer diameter allowing the use of thicker-walled packer elements; (4) an option of opening the packer collar with a plug or with internal casing pressure as opposed to a plug only; (5) a smooth bore through the internal diameter of the housing after the packer collar has been drilled out; and (6) no internal closing sleeve.

The shorter, more compact stage cementing packer collar of the present invention is easier to handle and make-up into the casing string than prior art stage cementing packer collars. The single piece housing increases the structural integrity of the housing over prior art housings that are welded together. The use of thicker-walled packer elements allows a given size stage cementing packer collar of the present invention to seal a larger annular space than the same size prior art tool. In other words, a thicker packer element will seal a larger annular space than a thinner packer element.

The cementing ports in the cementing tool of the present invention may be opened by internal casing pressure alone or in conjunction with a plug. Opening the cementing ports with casing pressure only saves valuable rig time in the operation of the tool. At the same time, the capability of opening the cementing ports using the conventional plug method serves as a valuable back up system. As a result, the present invention offers a system that is operationally faster and more reliable than conventional stage cementing packer collars.

The cementing tool of the present invention has an external closing sleeve for closing the cementing ports after the cementing job is completed. As a result, a smoother bore through the internal diameter of the housing remains after drill out of the packer collar. This facilitates the subsequent running of tools through the packer collar and reduces the likelihood of tool hangup inside the packer collar, which is a problem with prior art packer collars.

The present invention, while new in design, is based on the design of the ES Cementer, a stage cementing tool manufactured by Halliburton Services. The ES Cementer is generally described in U.S. Pat. No. 5,038,862 to Richard L. Giroux and John T. Brandell, which is incorporated herein by reference. The similarity of design reduces the manufacturing costs of the present invention by using several of the same parts used in the ES Cementer. The major differences between the present invention and the ES Cementer are that the present invention has (1) a longer housing to accommodate the setting sleeve and packer element; (2) an external setting sleeve to compress the packer element; and (3) a packer element for sealing the annulus between the casing and well bore or between the casing and another string of casing.

SUMMARY OF THE INVENTION

The present invention provides an improved cementing tool apparatus. The apparatus includes a tubular housing having an inner passage defined longitudinally therethrough and having a radially outer surface. The housing also has a cementing port and has a longitudinal slot both disposed through a wall thereof.

An outer closure sleeve is slidably received about the outer surface of the housing and is movable relative to the housing between an open position wherein the cementing port is uncovered by the closure sleeve and a closed position wherein the cementing port is closed by the closure sleeve.

An inner operating sleeve is slidably received in the inner passage of the housing and slidable between first and second positions relative to the housing.

A mechanical interlocking means extends through the slot and is operably associated with both the operating sleeve and the closure sleeve for mechanically transferring a closing force from the operating sleeve to the closure sleeve and thereby moving the closure sleeve to its closed position as the operating sleeve moves from its first position to its second position. The interlocking means preferably interlocks the operating sleeve and closure sleeve together for common longitudinal movement relative to said housing throughout the entire movement of said operating sleeve from its first position to its second position without any lost motion of the operating sleeve relative to the closure sleeve.

The closure sleeve itself is longitudinally hydraulically balanced and no unbalanced hydraulic force acts thereon at any time.

The apparatus includes a packer element for sealing the annular space below the cementing port between the casing and the borehole or between the casing and an outer string of casing.

A means for setting the packer element for sealing the annular space between the casing and the borehole or between the casing and an outer string of casing is also provided.

The improved cementing tool is designed for quick and easy drill-out of the internal components of the tool after the cementing job is completed thus leaving a smooth, unobstructed bore through the tool which is substantially free of any obstruction which can hang up other tools which will subsequently be run therethrough.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
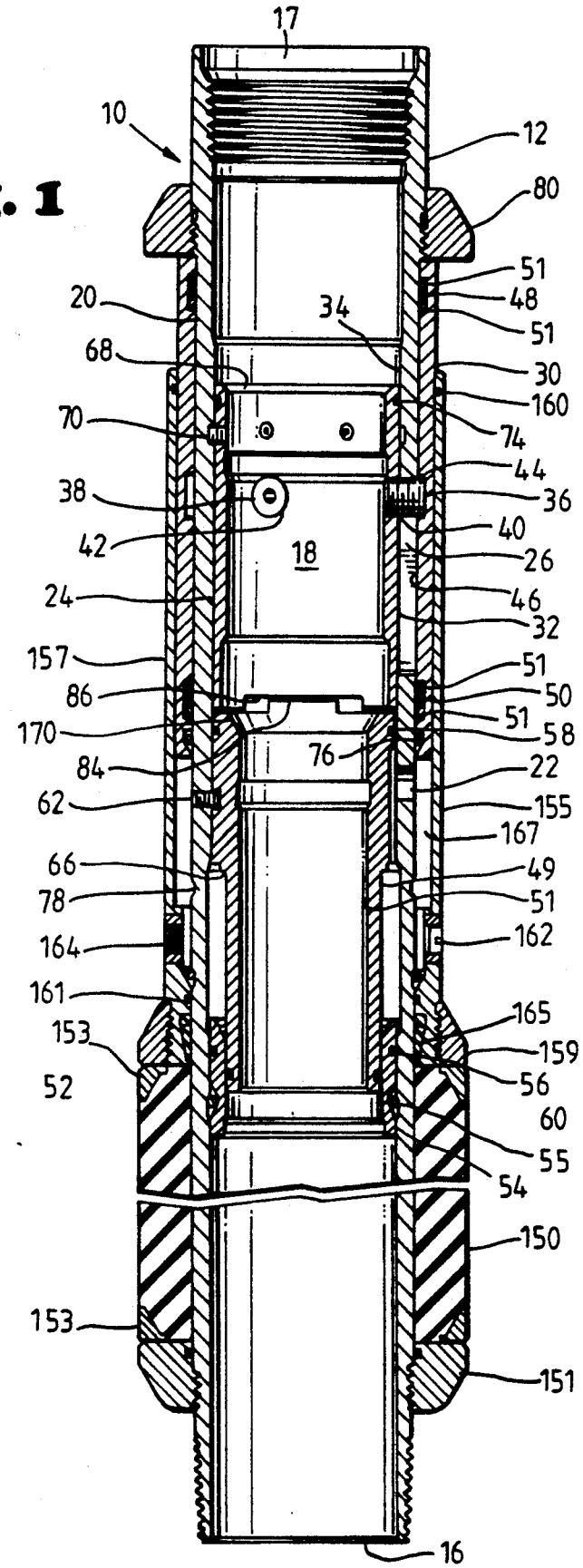
FIG. 1 is an elevation sectioned view of a preferred embodiment of the invention utilizing a hydraulically operated lower internal opening sleeve.

In FIG. 1, a cementing tool apparatus of the present invention is shown and generally designated by the numeral 10. The cementing tool 10 includes a tubular housing 12 having an upper end 14 and a lower end 16 with an inner passage 18 defined longitudinally therethrough from the upper end 14 to the lower end 16.

The tubular housing 12 has a radially outer surface 20. The housing 12 also includes a wall 24 having one or more cementing ports 22 disposed therethrough. The wall 24 also has three longitudinal slots disposed therethrough, one of which slots is shown in FIG. 1 and designated as 26.

The cementing tool 10 includes an outer, external closure sleeve 30 which is concentrically, closely, slidably received about the outer surface 20 of the housing 12. The closure sleeve 30 is movable relative to the housing 12 between an open position as seen in FIG. 1, and a closed position wherein the cementing port 22 is closed by closure sleeve 30.

The closure sleeve 30 can be described as an external sleeve and has a generally cylindrical radially outer surface which is at least partially exposed to the well annulus 124.

Figure 13:
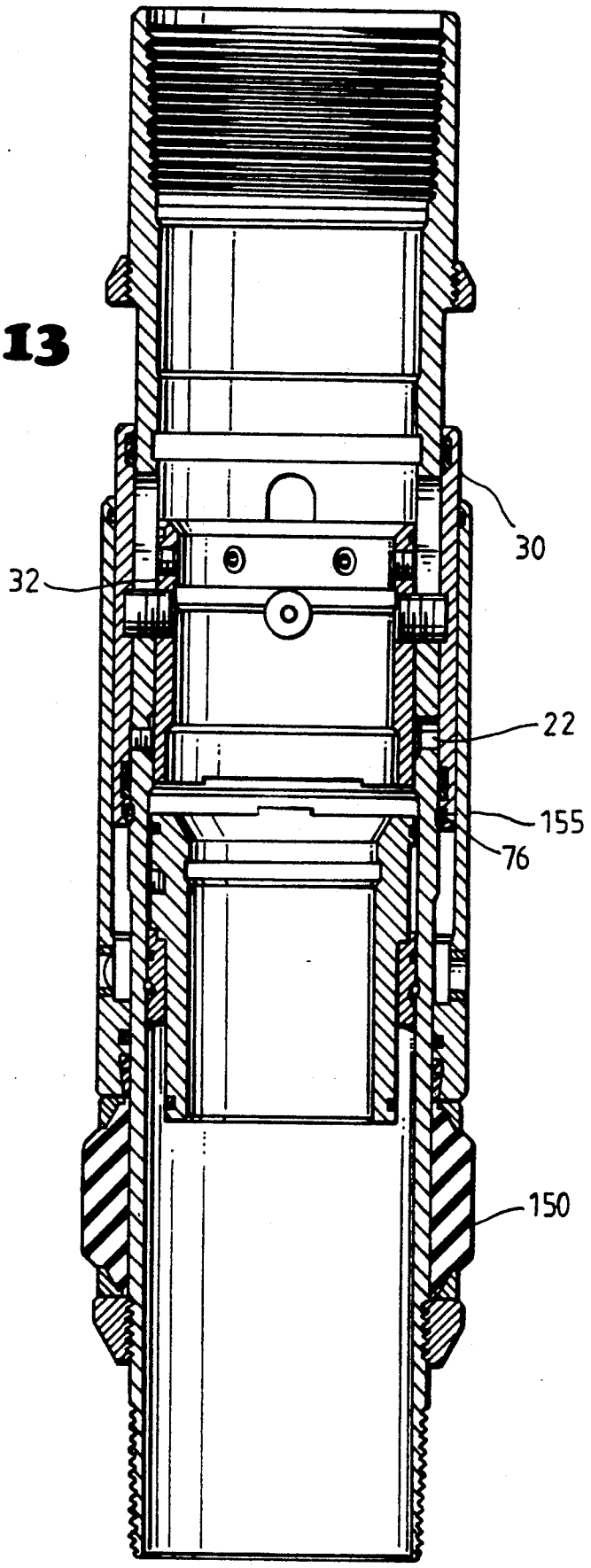

Cementing tool 10 includes an inner operating sleeve 32 which is slidably received in an inner bore 34 of housing 12. The operating sleeve 32 is slidable between a first position relative to housing 12 as seen in FIG. 1, and a second position corresponding to the closed position of closure sleeve 30 as schematically illustrated in FIG. 13.

Three pins, two of which are seen in FIG. 1 and designated as 36 and 38, extend through the slots in wall 24 and are fixably connected to the operating sleeve 32 and the closure sleeve 30 to interlock the operating sleeve 32 and closure sleeve 30 for common longitudinal movement relative to the housing 12 throughout the entire movement of the operating sleeve 32 from its first position to its second position. Since the pins 36 and 38 fixedly connect operating sleeve 32 to closure sleeve 30, there is not lost longitudinal motion of the operating sleeve 32 relative to the closure sleeve 30 as the operating sleeve 32 moves downward to close the cementing port 22 with the closure sleeve 30.

The pins 36 and 38 are threadedly engaged with threaded radial bores such as 40 and 42 extending through the operating sleeve 32 and tightly engage an internal annular groove 44 cut in the inner bore 46 of closure sleeve 30.

The pins such as 36 and 38 and their engagement with the operating sleeve 32 and closure sleeve 30 can all be referred to as a mechanical interlocking means extending through the slots in wall 24, such as 26, and operably associated with both the operating sleeve 32 and the closure sleeve 30 for transferring a closing force from the operating sleeve 32 to the closure sleeve 30 and thereby moving the closure sleeve 30 to its closed position as the operating sleeve 32 moves from its first position to its second position.

Pins 36 and 38 also serve to hold sleeve 32 so that it will not rotate as sleeve 32 is later drilled out of housing 12 after the cementing job is completed.

The cementing tool 10 includes an upper sliding seal 48 and a lower sliding seal 50 disposed in annular grooves cut in the bore 46 of closure sleeve 30 near its upper and lower ends. Preferably, the upper and lower sliding seals 48 and 50 include an O-ring held between two annular backup sealing rings 51. When the closure sleeve 30 is in its open position as seen in FIG. 1, both the seals 48 and 50 are located above the cementing port 22. When the closure sleeve 30 is moved downward to its closed position, the lower seal 50 is located below cementing port 22 and the upper seal 48 is located above the cementing port 22 to effectively close the cementing port. Thus, the apparatus 10 can be said to have two sliding seals between the closure sleeve 30 and the outer surface 20 of housing 12, one of said seals 48 being located above the cementing port 22 and the other seal 50 being located below the cementing port 22 when the closure sleeve 30 is in its said closed position.

Since both the upper seal 48 and lower seal 50 engage identical outside diameters of the outer surface 20 of housing 12, there is no unbalanced hydraulic pressure acting on the closure sleeve 30. Thus, the closure sleeve 30 can be described as being longitudinally hydraulically balanced.

As is apparent in FIG. 1, the inner passageway 18 of housing 12 is always in fluid pressure communication with the bore 46 of closure sleeve 30 between its upper and lower seals 48 and 50. In the position illustrated in FIG. 1, there is no seal between the lower end of operating sleeve 32 and the slots such as 26, thus fluid pressure within the passage 18 will reach the bore 46 of closure sleeve 30 between the seals 48 and 50, but due to the fact that closure sleeve 30 is hydraulically balanced, this pressure will not exert any unbalanced longitudinal force on the closure sleeve 30.

Figure 4A:
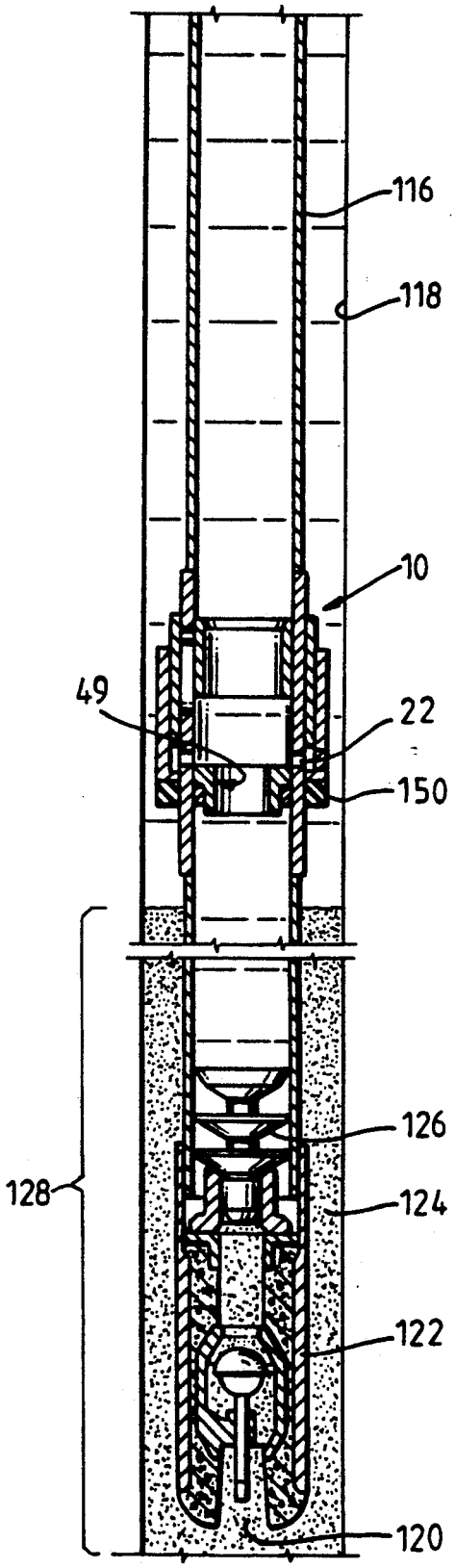
Figure 10:
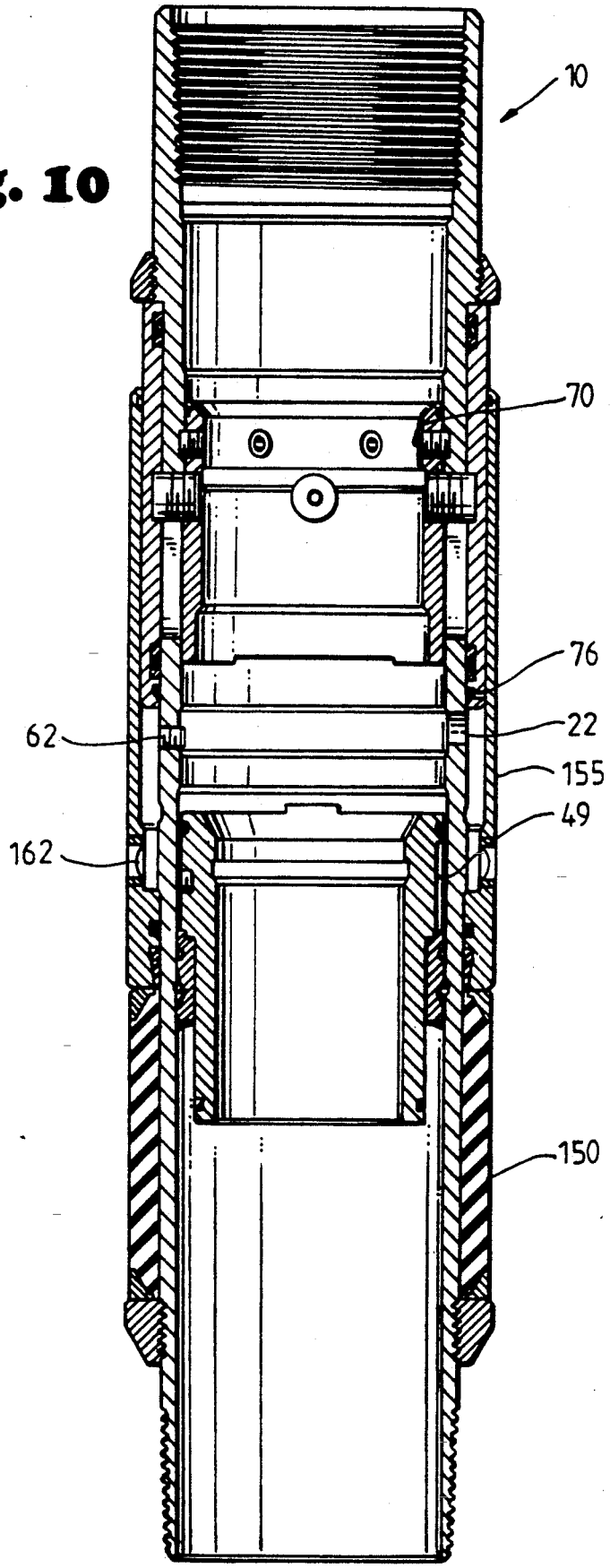

The cementing tool 10 further includes an internal lower opening sleeve 49 slidably received in the bore 34 of housing 12 below the operating sleeve 32. The opening sleeve 49 is slidable between a closed position as shown in FIG. 1 wherein the cementing port 22 is closed by the opening sleeve 49 and an open position, such as is schematically illustrated in FIG. 4A and FIG. 10 wherein the cementing port 22 is uncovered by the opening sleeve 49 as the opening sleeve downward relative to housing 12. It is noted that when the opening sleeve 49 is in its closed position as is seen in FIG. 1 and the operating sleeve 32 is simultaneously in its first position as shown in FIG. 1, the inner passage 18 of housing 12 is in fluid pressure communication with the bore 46 of closure sleeve 30 between it sliding seals 48 and 50.

Cementing tool 10 includes elastomeric packer element 150 which is concentrically and closely received about the outer surface 20 of housing 12. Packer element 150 is preferably cylindrical in shape and abuts bottom shoe 151 on cementing tool 10. Bottom shoe 151 is threadedly connected to the lower end of housing 12. Bottom shoe 151 may be manufactured with a tapered lower end as shown in FIG. 1, which facilitates the lowering of cementing tool 10 into the well bore. Packer element 150 may have upper and lower support rings located on the external upper and lower edges of the packer element and shown as 153, which support the elastomeric packer element during the sealing operation.

Cementing tool 10 further includes an external setting sleeve 155 for compressing packer element 150. Setting sleeve 155 preferably is an elongate cylindrical sleeve which is slidably mounted about cementing tool 10 as shown in FIG. 1. It includes a thin wall upper section 157 which is slidably received on the external surface of closure sleeve 30. Setting sleeve 155 includes a thicker wall lower section, to which setting sleeve shoe 159 is threadedly attached. Setting sleeve shoe 159 is a tapered ring which abuts the upper end of packer element 150.

Setting sleeve 155 contains upper sliding seal 160 and lower sliding seal 161, typically O-ring seals, which are located in grooves cut in the internal bore of the setting sleeve. Upper seal 160 engages the external surface of closure sleeve 30, while lower seal 161 engages the outer surface 20 of housing 12, so that a differential area is defined between seals 160 and 161.

Setting sleeve 155 includes, preferably, two rupture disks, one of which is shown in FIG. 1 as 162. The rupture disks are positioned inside ports disposed through the lower section of setting sleeve 155. The rupture disks effectively seal the ports while the rupture disks are intact. Radially displaced from the rupture disks is a pressure equalizing valve 164, which monitors the pressure differential between the fluid pressure outside the setting sleeve and inside the setting sleeve. Pressure equalizing valve 164 is a one way valve which controls the pressure differential acting on the rupture disks by allowing annular fluid to pass into the internal bore of the setting sleeve 155 when the annular pressure exceeds the pressure inside the setting sleeve.

The opening sleeve 49 in the embodiment of FIG. 1 is a hydraulically operated sleeve. It includes a reduced diameter lower portion 51 which is slidably received within a bore 52 of an anchor ring 54 which is fixedly attached to the inner bore 34 of housing 12 such as by lock ring 55. An O-ring seal 56 seals between anchor ring 54 and housing 12.

Opening sleeve 49 carries an upper annular sliding seal 58 which engages the bore 34 of housing 12, and carries a lower annular sliding seal 60 which engages the reduced diameter bore 52 of anchor ring 54, so that a differential area is defined between seals 58 and 60. Opening sleeve 49 is initially shear pinned in its closed position as shown in FIG. 1 by a plurality of shear pins 62 which are threaded through the wall of housing 12 and engage holes in the opening sleeve.

As is further described below with regard to FIG. 4, the interior of the casing string in which the apparatus 10 is located can be closed off below the cementing tool 10 so that a high fluid pressure can be applied to the passage 18 through housing 12 which pressure will act downward on the differential area between seals 58 and 60 until the force exceeds that which can be held by the shear pins 62. Then the shear pins 62 will shear and the downward acting differential pressure will move the opening sleeve 49 downward until a lower shoulder 66 thereof engages the anchor ring 54. At that point, the upper seal 58 is located below cementing port 22 so that the cementing port 22 is open to the passage 18 through housing 12.

Alternatively, opening sleeve 49 may be activated by a plug means such as a free fall plug or a pump down plug which seals the opening through the opening sleeve. The plug will land on the tapered profile 170 on the top of opening sleeve 49. After the plug has landed on opening sleeve 49, fluid pressure is applied to passage 18 until the force acting on the plug exceeds that which can be held by the shear pins 62. Once the shear pins have sheared, the pressure will move opening sleeve 49 downward until it engages anchor ring 54, thereby exposing cementing port 22. The plug means may be configured to prevent rotation with respect to opening sleeve 49 to facilitate drill out after the cement job has been completed.

A non-rotating engagement is provided between the shoulder 66 of opening sleeve 49 and the upper end of anchor ring 54 by a lug and recess type interlocking structure (not shown) similar to lug 84 and recess 86 described below.

After the opening sleeve 49 has been moved down to its open position thereby exposing cement ports 22, the fluid pressure will act downward on the differential area between seals 160 and 161 on the setting sleeve 155. The downward force exerted on the setting sleeve will cause the setting sleeve to move downward toward the stationary bottom shoe 151. The downward movement of setting sleeve 155 will compress the elastomeric packer element 150 against bottom shoe 151 until the packer element expands to the borehole wall or to the outer casing, effectively sealing the annular space, and protecting the formations below the cementing tool from the hydrostatic pressure of the subsequent cement job.

Lock ring 165 is located in a tapered groove cut into the internal bore of setting sleeve 155. Lock ring 165 is configured to the tapered groove cut into the internal bore of the setting sleeve such that upward movement of setting sleeve is prevented by frictional interference with the lock ring. The lock ring is tapered to allow downward movement of the setting sleeve with respect to housing 12 while preventing the upward movement of the setting sleeve. Thus, lock ring 165 is operable to lock the setting sleeve after the latter has compressed the packer element into the sealing position.

After the packer element has been set, the internal pressure applied to passage 18, and exerted through cement ports 22 and passage 167 onto the rupture disks, is steadily increased until one of the rupture disks ruptures. Once a rupture disk ruptures, cement can be pumped downward through the passage 18, out the cementing ports 22, through passage 167 and out the port left by the ruptured rupture disk in a manner further described below with reference to FIGS. 3–8.

After sufficient cement has been pumped out through cementing ports 22 and out the port left open by the ruptured rupture disk, the closure sleeve 30 is closed by means of the operating sleeve 32. A closing force is applied to the operating sleeve 32 by a plug means which will seat on an annular seat 68 defined on the upper end of operating sleeve 32. The operating sleeve is initially held in place relative to housing 12 by a plurality of shear pins 70 which are threaded through the operating sleeve 32 and received in a groove (not shown) in the bore 34 of housing 12. An upper sliding O-ring 74 seals between the operating sleeve 32 and the housing 12.

When the shear pins 70 are sheared due to a downward force acting on the operating sleeve 32, the operating sleeve moves downward carrying the closure sleeve 30 with it. The closure sleeve 30 carries an inwardly biased locking ring 76 in a groove contained near its lower end. The locking ring 76 will snap into an outer annular groove 78 defined in the housing 12 to mechanically lock the closure sleeve 30 in its closed position relative to housing 12.

Upper external support ring 80 is fixedly attached to the housing 12 at or near the position of the upper end of the closure sleeve 30 when the closure sleeve is in its open position. The support ring 80 along with bottom shoe 151 and setting sleeve shoe 159 have outside diameters equal to or greater than the outside diameter of setting sleeve 155 so that if the tool 10 is placed against the wall of a casing, the ring 80 and shoes 151 and 159 will hold the tool such that the setting sleeve 155 can still slide downward relative to housing 12 without binding against the casing. Support ring 80 and shoes 151 and 159 also provide protection for tool 10 as the casing string incorporating tool 10 is run into the borehole.

Packer element 150 may be manufactured to various diameters so that different size annuluses may be sealed with a given size cementing tool. In general, the packer element diameter will increase as the size of the annular space to be sealed increases. Accordingly, support ring 80 and shoes 151 and 159 may be manufactured in a variety of sizes as well.

The opening sleeve 49 has an upward extending lug 84 which will be received within a downward facing recess 86 in the lower end of operating sleeve 32 when the operating sleeve 32 moves downward to a position corresponding to the closed position of closure sleeve 30. This prevents the operating sleeve 32 from rotating relative to the opening sleeve 49 and housing 12 at a later time when the internal components are drilled out of the housing 12.

The cementing tool 10 of FIG. 1 is particularly designed for use with a cementing plug means 88 (see FIGS. 4–7) including a bottom plug 90 and a top plug 92. As is further described below, the cementing plug means 88 is used in connection with the second stage of cement which is pumped through the cementing port 22 of cementing tool 10.

The cementing tool 10 and its associated cementing plug means 88 may be designed so that the cementing plug means 88 will not rotate relative to the housing 12 of cementing tool 10 when the cementing plug means 88 and other internal components of the cementing tool 10 are drilled out of the housing 12 after the cementing job is completed. This non-rotatable feature preferably is like that shown in U.S. Pat. No. 5,038,862 to Giroux et al., which is incorporated herein by reference.

As will be appreciated by those skilled in the art, the bottom plug 90 is utilized to separate the bottom of a column of cement 106 from well fluids 108 located therebelow to prevent contamination of the cement prior to the time it is pumped through the cementing port 22.

Figure 5:
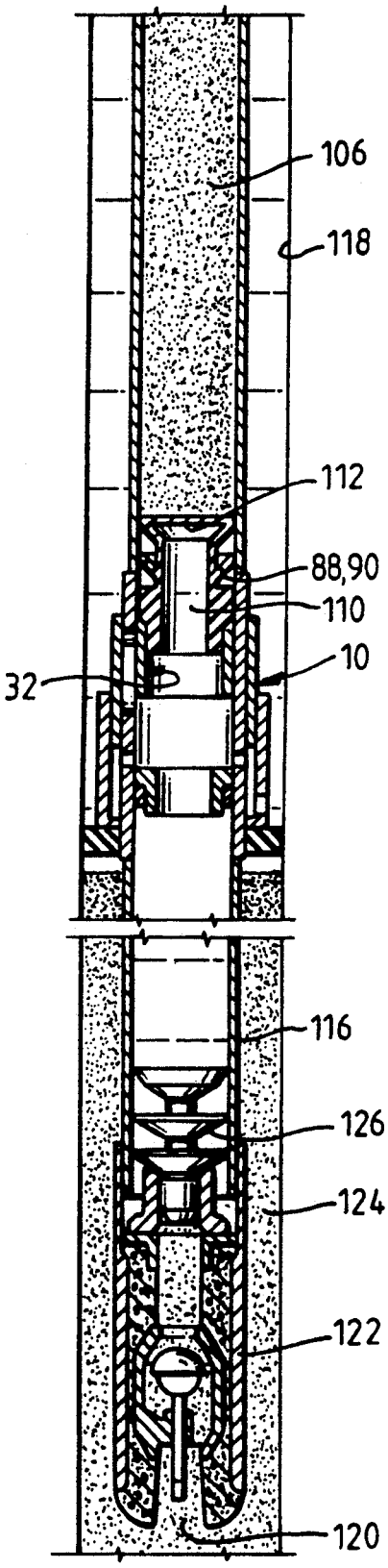

The bottom cementing plug 90, as best seen in the somewhat schematic sectioned view of FIG. 5 has a passage 110 therethrough which is initially closed by a rupture disc or diaphragm schematically illustrated as 112.

Figure 6:
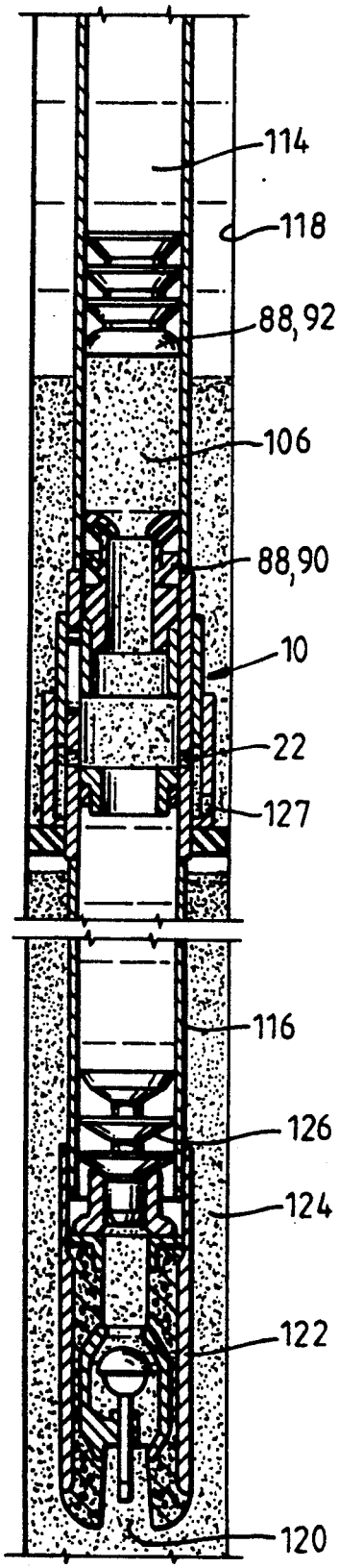

When the bottom plug 90 seats against seat 68 of operating sleeve 32 as schematically represented in FIG. 5, pressure on the cement column 106 is increased until the rupture disc 112 ruptures as represented in FIG. 6 thus permitting the cement to flow downward through the passage 110 of bottom plug 90 into the passage 18 of housing 12 of cementing tool 10, out through cementing port 22 and out opening 127.

Figure 7:
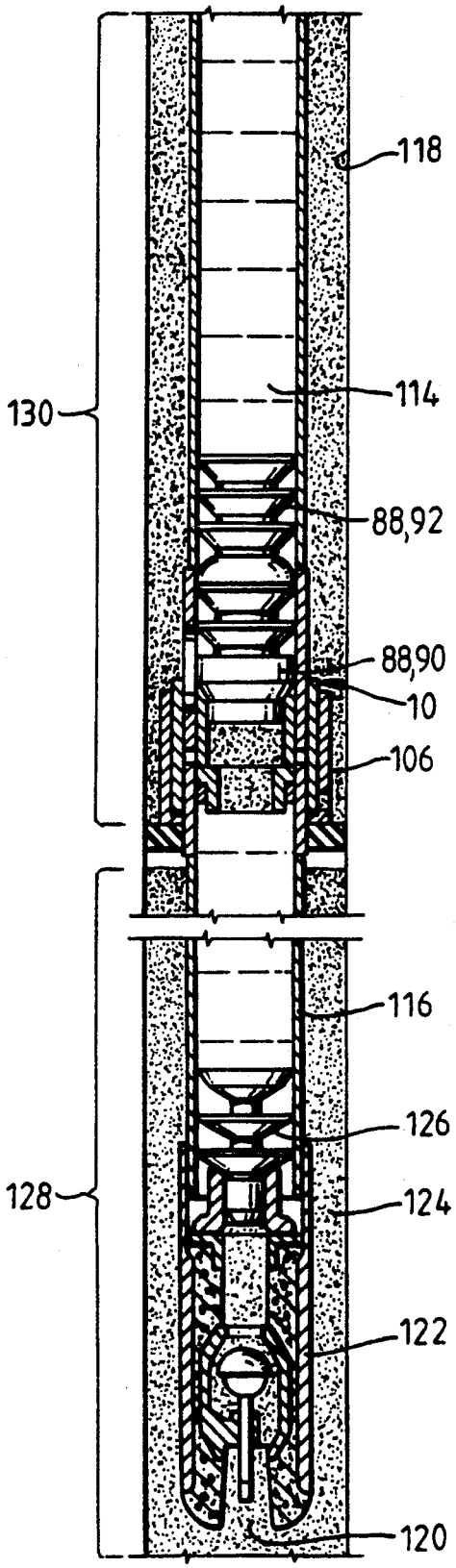

As schematically illustrated in FIG. 6, the top plug 92 separates the upper extremity of the cement column 106 from a working fluid 114 thereabove. The top plug 92 is a closed plug having no passage therethrough, and when it engages bottom plug 90 as schematically illustrated in FIG. 7, the top plug 92 seals against bottom plug 90 closing the passage 110 therethrough. A non-rotatable engagement may be provided between top plug 92 and bottom plug 90 to prevent top plug 92 from rotating relative to bottom plug 90 when the plugs are later drilled out. This non-rotatable engagement between the top and bottom plugs preferably is like that shown in U.S. Pat. No. 4,858,687 to Watson et al. which is incorporated herein by reference.

After the top plug 92 has seated on the bottom plug 90 as schematically illustrated in FIG. 7, further fluid pressure can be applied to the working fluid 114 thereabove to shear the shear pins 70 holding the operating sleeve 32 in the place relative to housing 12, thus allowing the operating sleeve 32 and closure sleeve 30 to move downward to the closed position of closure sleeve 30.

The shear pins 70 must be designed such that they can safely withstand the downward force applied thereto when pressure is applied to rupture the rupture disc 112 to bottom plug 90, and the shear pins 70 must also be designed so that they will shear and release the operating sleeve 32 at a predetermined pressure after the top plug 92 seats against bottom plug 90.

The shear pins 70 may be collectively referred to as a releasable retaining means 70 for initially retaining the operating sleeve 32 in place relative to housing 12 with the cementing port 22 open as the rupture disc 112 of bottom cementing plug 90 is ruptured to open the passage 110 through the bottom cementing plug 90. It is also noted that the apparatus 10 could be used with only a top cementing plug similar to plug 92.

METHOD OF OPERATION UTILIZING THE APPARATUS OF FIG. 1

The major steps of a multi-stage well cementing job utilizing the cementing tool 10 are schematically illustrated in FIGS. 3–8. FIGS. 9–14 illustrate the cementing tool 10 in more detail during the various phases of a stage cement job as shown in FIGS. 3–8.

A well casing string 116 is located within a well bore 118. The cementing tool 10 is placed in the casing string 116 before it is run into the well bore 118. It may be inserted between standard threaded connections of the casing at the desired locations of various cementing stages. A number of cementing stages are possible as long as each cementing tool 10 in the casing string 116 has a smaller inner diameter than the cementing tool immediately above it.

Figure 3:
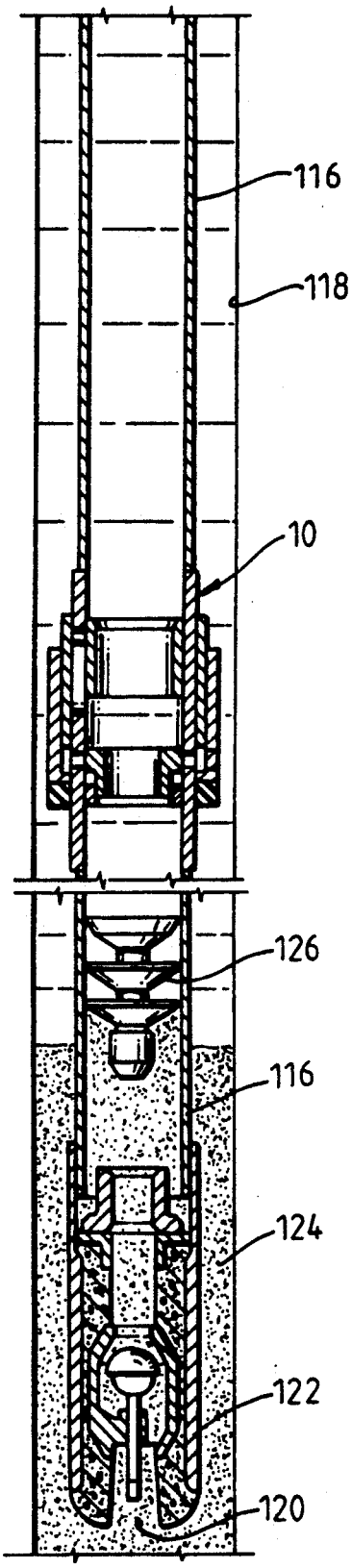
FIGS. 3, 4A–4C, and 5–8 comprise a sequential series of views illustrating the use of the cementing tool of FIG. 1 to stage cement a well.
Figure 9:
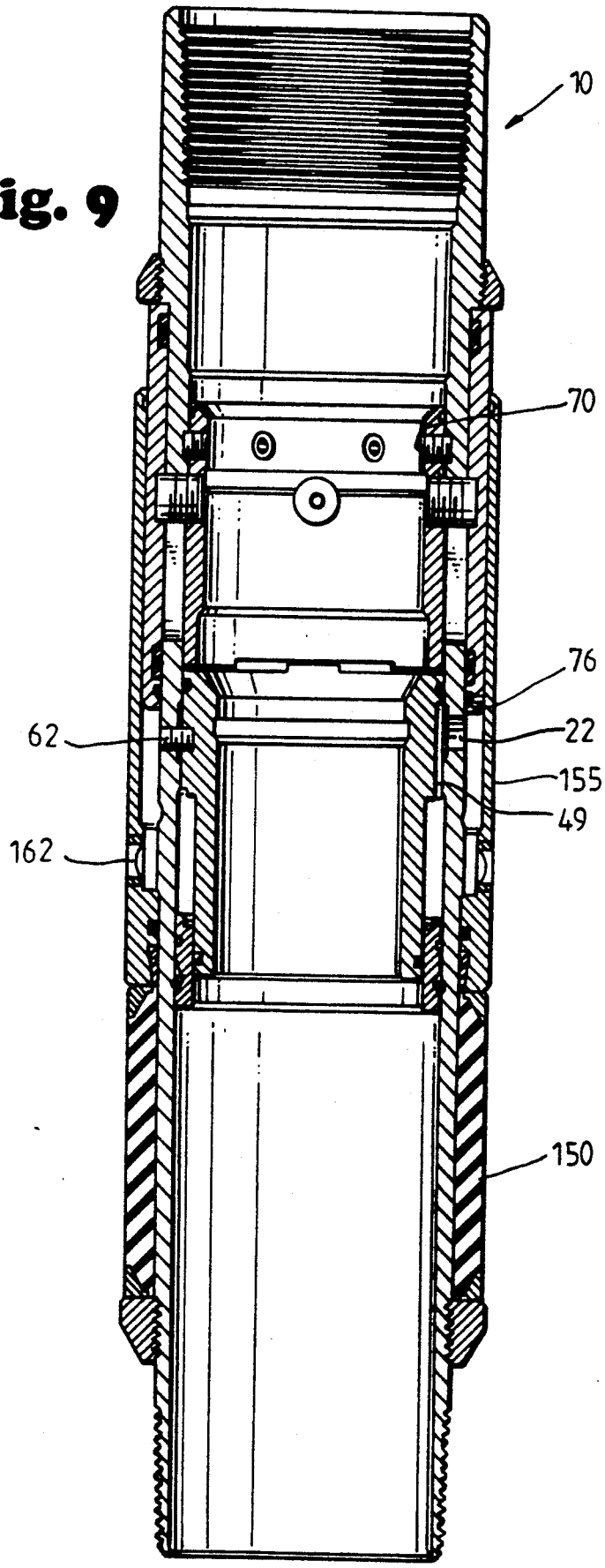
FIGS. 9–14 represent the cementing tool of FIG. 1 during the various phases of a stage cement job as illustrated in FIGS. 3–8.

After the casing string 116 is in place within the well bore 118, the first or lowermost stage of cementing may be accomplished through a bottom opening 120 in a float shoe 122 arranged at the lower end of the casing string 116. As illustrated in FIG. 3, the cement flows downward through casing string 116 out the opening 120 and up into a well annulus 124 defined between the casing string 116 and well bore 118. A wiper plug 126 is inserted behind the first stage of cement slurry and displacing fluid is pumped behind the wiper plug 126 to displace the cement from the casing string 116. FIG. 9 shows the position of the various components of cementing tool 10 during the step illustrated in FIG. 3.

As seen in FIG. 4A, the wiper plug 126 will seat in the float shoe 122 thus stopping flow of the first stage of cement 128 up into the annulus 124. The first stage 128 of cement will extend to some point below the cementing port 22 of the cementing tool 10.

With the wiper plug 126 sealing the lower end of the casing string 116, pressure within the casing string 116 can be increased and will act against the differential area defined on opening sleeve 49 until the shear pins 62 are sheared and opening sleeve 49 of cementing tool 10 moves downward thus uncovering and opening the cementing port 22 as schematically illustrated in FIG. 4A and FIG. 10.

Figure 4B:
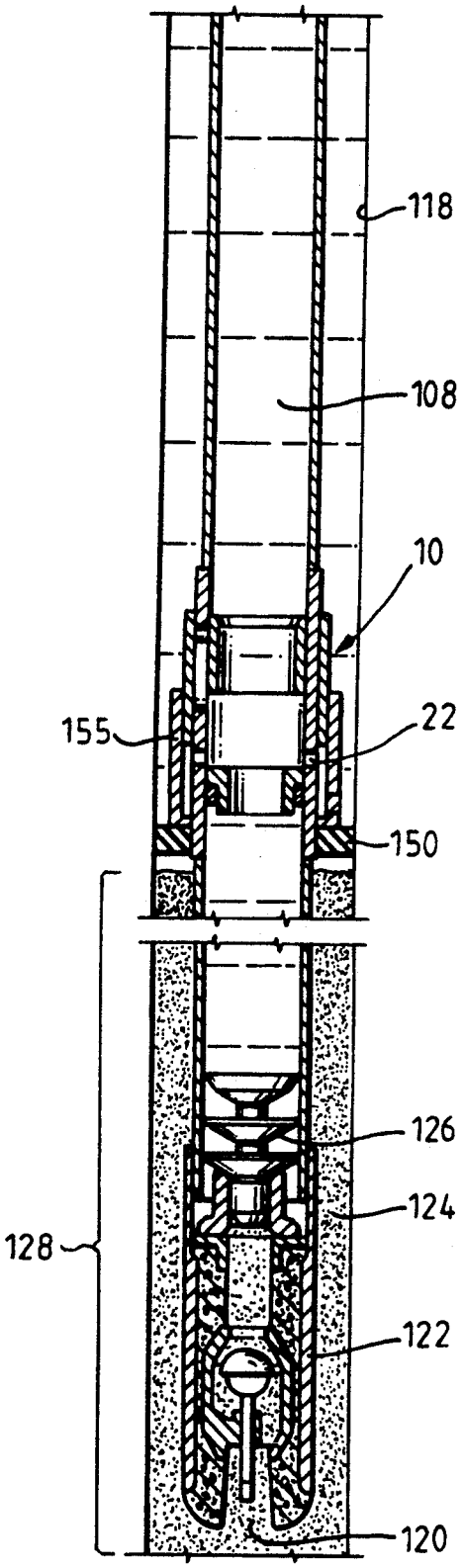
Figure 11:
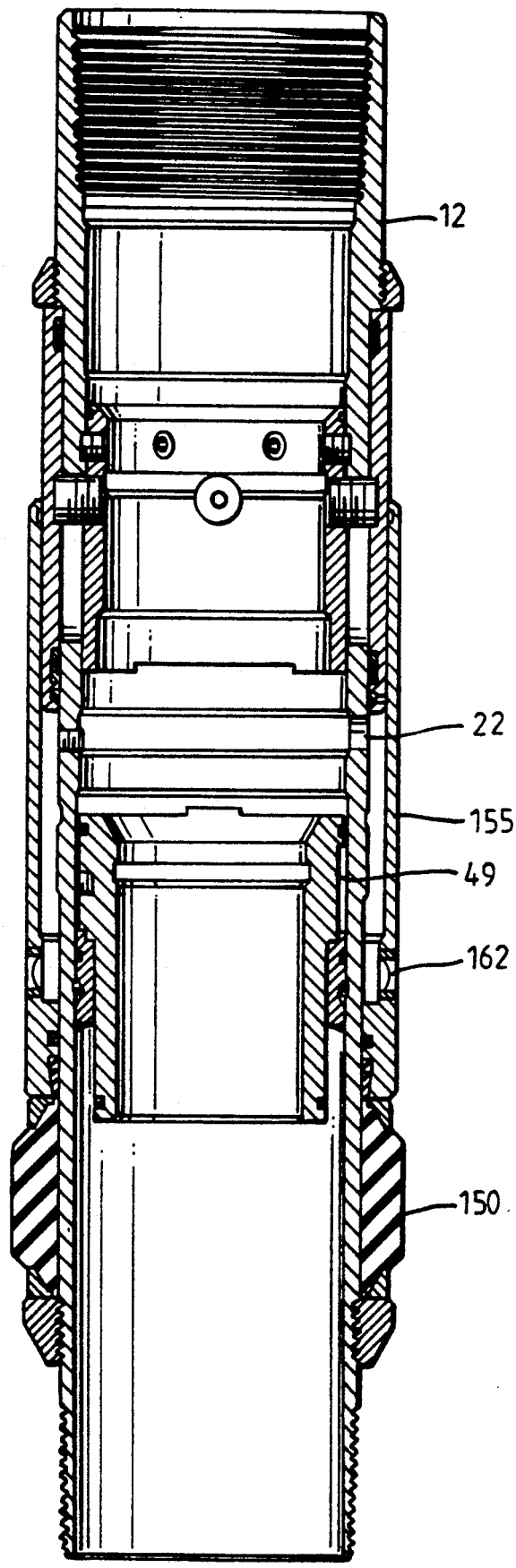

Pressure within casing string 116 is gradually increased until as the pressure is exerted through cementing port 22 and against the differential area on setting sleeve 155. The pressure acting against the differential area on setting sleeve 155 will cause the setting sleeve 155 to move downward, compressing packer element 150 until packer element 150 seals annulus 124, as schematically illustrated in FIG. 4B and FIG. 11.

Figure 4C:
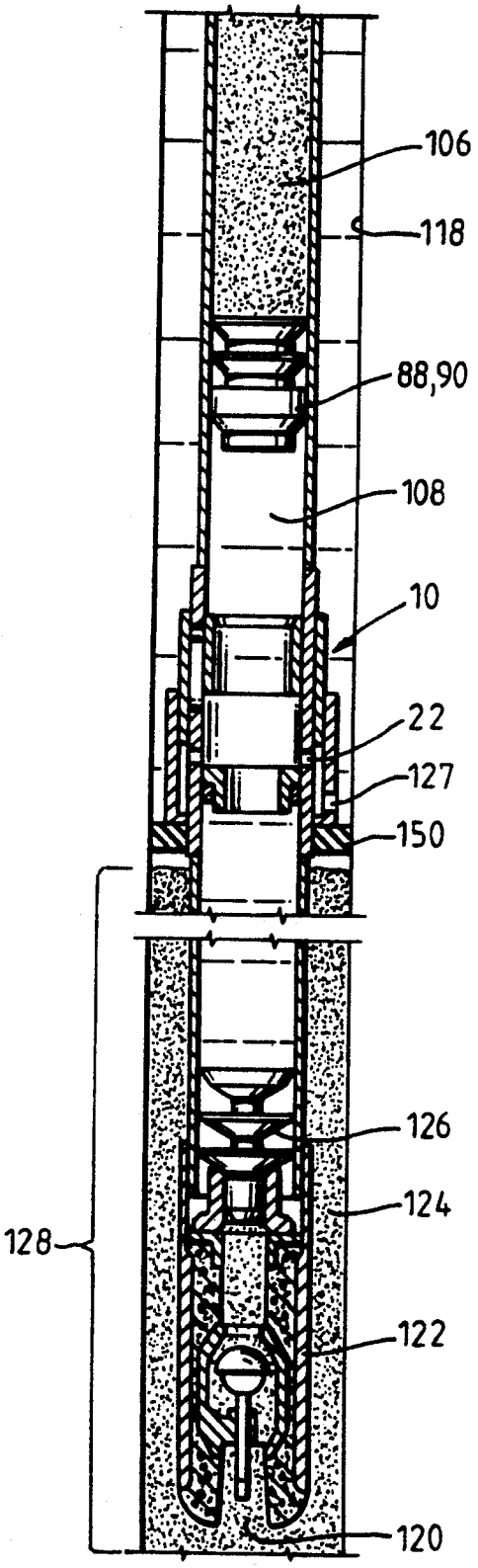

Pressure within casing string 116 is gradually increased until a rupture disk ruptures (not shown), allowing fluid to circulate down casing string 116, through cementing port 22, out the opening 127 created by the ruptured rupture disk, and up annulus 124. Then cement 106 for the second stage cementing can be pumped down the casing 116 with the displacing fluids located therebelow being circulated through the cementing port 22, through opening 127 and back up the annulus 124 as shown in FIG. 4C. As previously indicated, a bottom cementing plug 90 is run below the cement 106 and a top plug 92 is run at the upper extremity of the cement 106.

Figure 12:
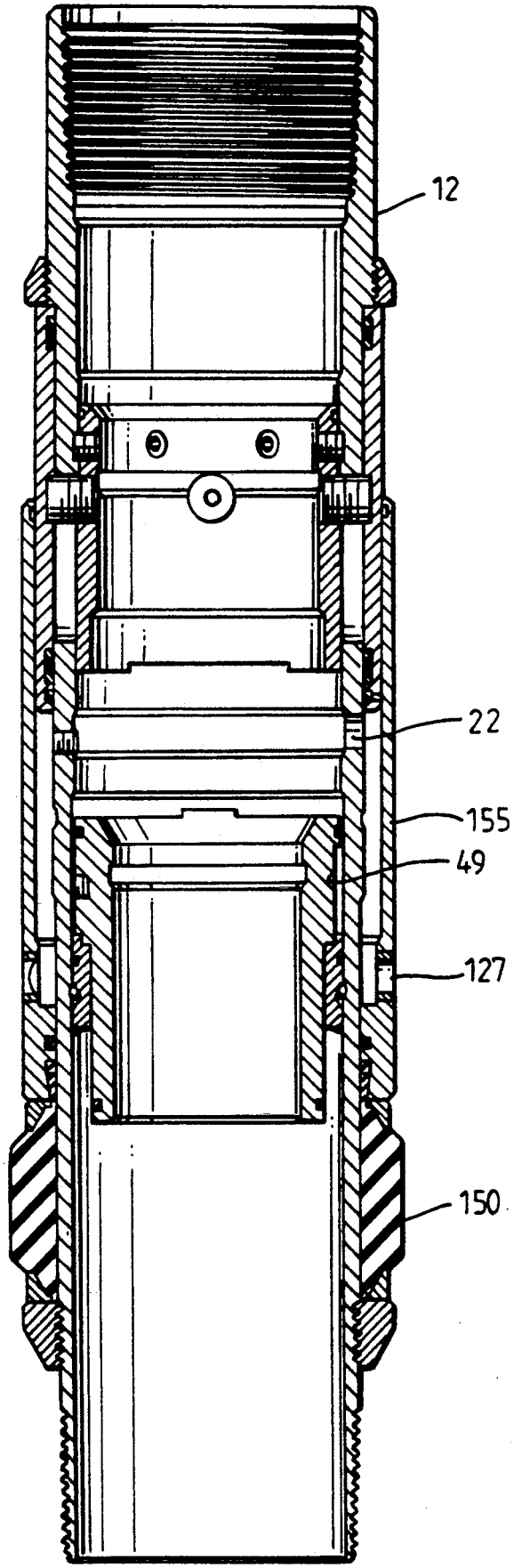

The bottom plug 90 will seat against operating sleeve 32 as illustrated in FIG. 5. Further pressure applied to the cement column 106 will rupture the rupture disc 112 of bottom cementing plug 90 as illustrated in FIG. 6, and the second stage cement then flows out of cementing port 22, out opening 127 and upward through the annulus 124. FIG. 12 represents cementing tool 10 during the steps illustrated by FIGS. 4C, 5, and 6.

When the top plug 92 seats against bottom plug 90 closing the same, as shown in FIG. 7, the second stage of cementing represented by annular cement column 130 is terminated. Increasing the pressure within casing string 116 will eventually shear the shear pins 70, causing operating sleeve 32 to move downward, taking the closure sleeve 30 with it. Lock ring 76 will lock closure sleeve 30 in its closed position, thereby sealing cementing port 22. FIG. 13 illustrates cementing tool 10 with closure sleeve 30 in its closed position.

Figure 8:
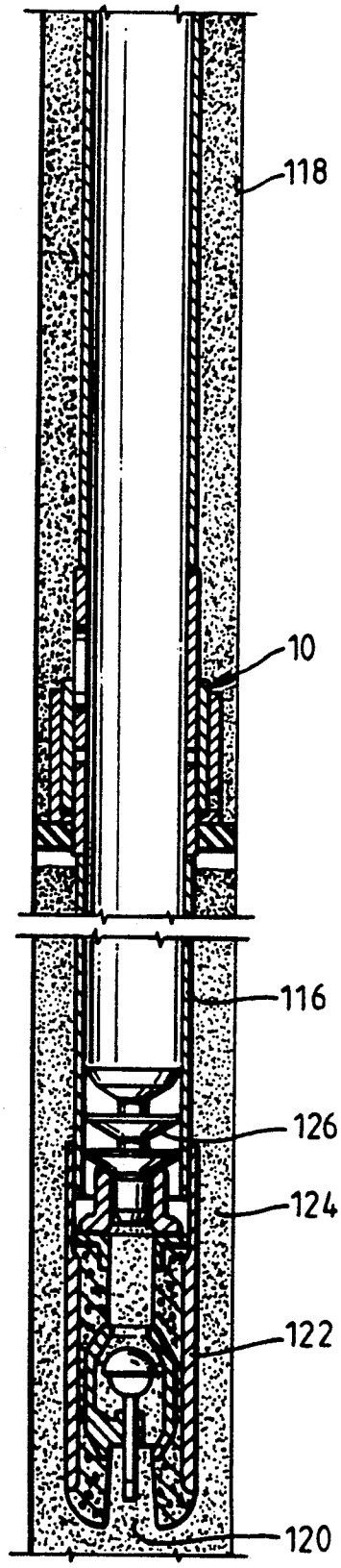
Figure 14:
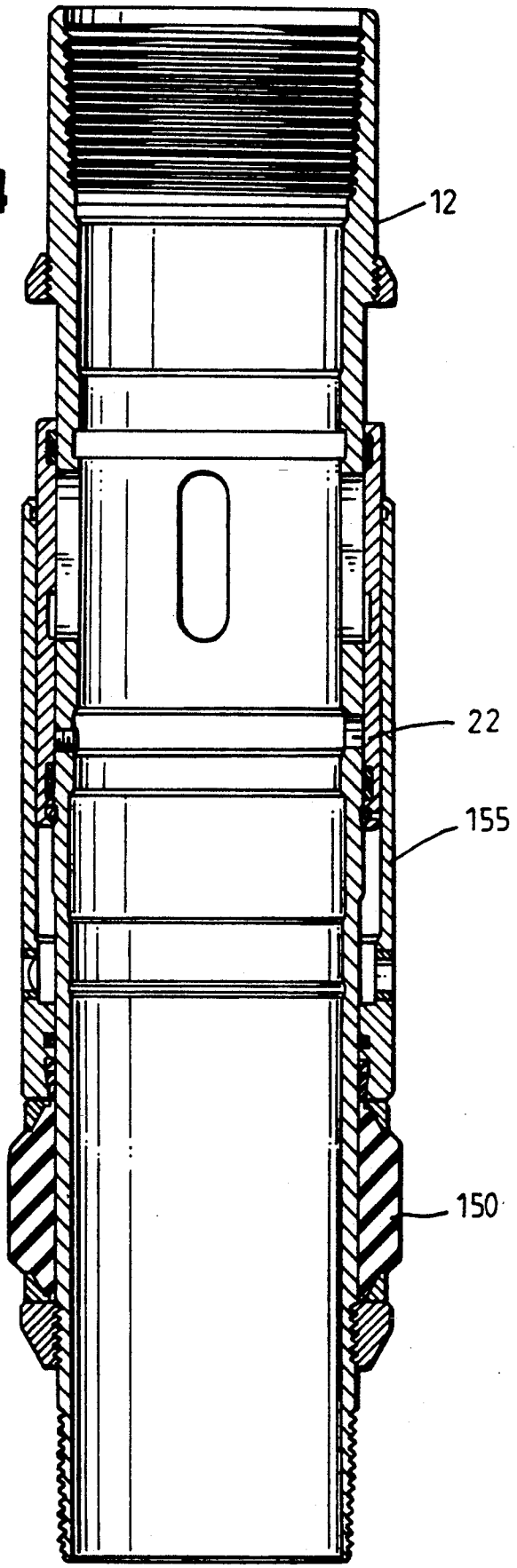

Subsequently, the cementing plugs 90 and 92, and the operating sleeve 32 and opening sleeve 49 and anchor ring 54 (not shown) can all be drilled out of the casing 12 leaving a smooth bore through the cementing tool 10 as schematically illustrated in FIG. 8 and FIG. 14. The components to be drilled out of housing 12 including the operating sleeve 32, opening sleeve 49 and anchor ring 54 are all made from easily drillable materials such as aluminum. The cementing plugs 90 and 92 may be made of aluminum, plastic and/or rubber components which are easily drilled.

ALTERNATIVE EMBODIMENT OF FIG. 2

Figure 2:
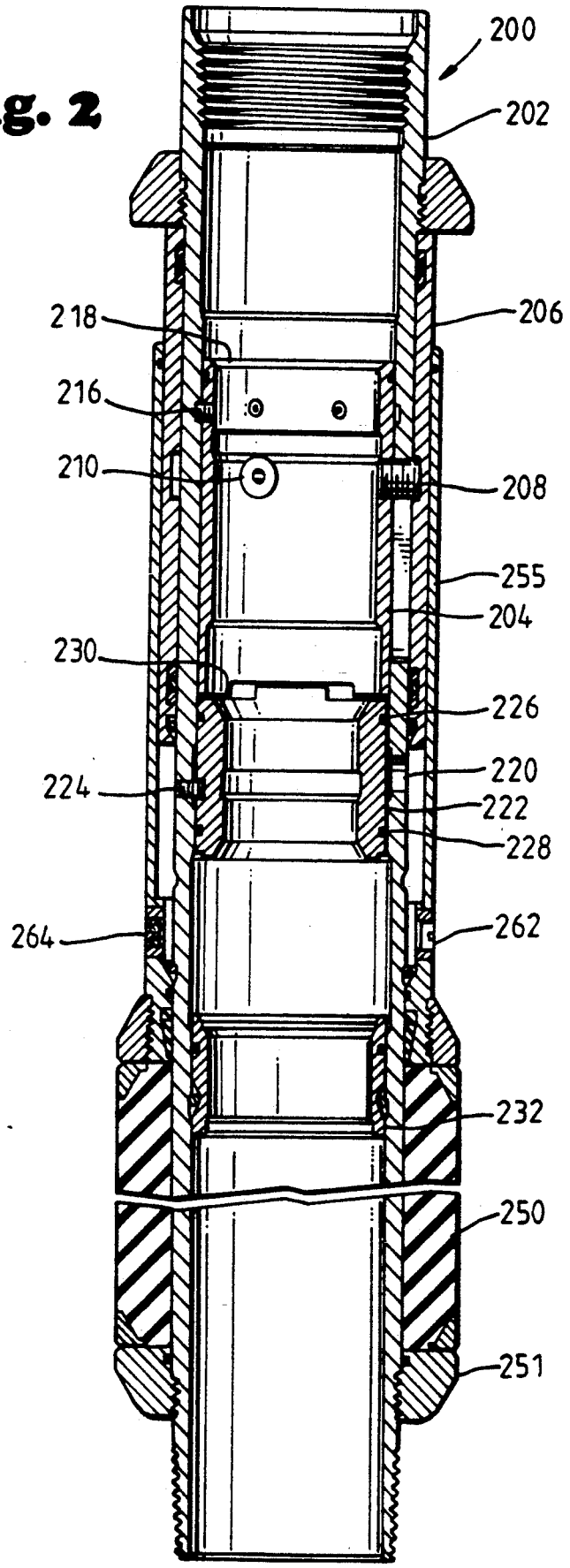
FIG. 2 is an elevation view sectioned view of an alternative embodiment of the invention utilizing a plug actuated lower internal opening sleeve.

FIG. 2 illustrates an alternative embodiment of the cementing tool of the present invention which is shown and generally designated by the numeral 200. The cementing tool 200 differs primarily in that its opening sleeve is not hydraulically actuated but instead is designed to be actuated by engagement of a pump-down plug or free-all plug which seals the opening through the opening sleeve.

The cementing tool 200 includes a housing 202. An operating sleeve 204 is received therein. A closure sleeve 206 is received about the housing 202. A series of pins such as 208 and 210 extend through slots in housing 202 to fixedly connect the operating sleeve 204 and closure sleeve 206. Shear pins 216 initially hold the operating sleeve 204 in place relative to housing 202. An annular seat 218 is defined upon the upper end of operating sleeve 204 for engagement with a cementing plug.

A cementing port 220 is disposed through the housing 202.

An opening sleeve 222 is located within the housing 202 and is initially held in place relative thereto by shear pins 224.

Upper and lower sliding O-ring seals 226 and 228 are carried by opening sleeve 222. The seals 226 and 228 are above and below, respectively, the cementing port 220 when the opening sleeve 222 is in its initial closed position as shown in FIG. 2.

The opening sleeve 222 has an annular seat 230 defined on its upper end which is constructed for engagement with a free-fall or pump-down plug (not shown). When the free-fall or pump-down plug engages seat 230 fluid pressure applied thereto acts downward to shear the shear pins 224 so that the plug and opening sleeve 222 can move downward until the opening sleeve 222 abuts an anchor ring 232. The upper O-ring seal 226 is then located below cementing port 220 so that fluid may be pumped through the cementing port 220 in a manner similiar to that previously described with regard to the embodiment of FIG. 1.

Cementing tool 200 includes packer element 250 which is concentrically located about the outer surface of housing 202. The lowermost end of packer element 250 abuts bottom shoe 251.

Cementing tool 200 further includes an external setting sleeve 255 for compressing packer element 250. External setting sleeve 255 has preferably two rupture disks, one of which is shown in FIG. 2 as 262, and a pressure equalizing valve 264.

Fluid pressure exerted inside housing 202 will be communicated through cementing port 220 and act on external setting sleeve 255 in a manner similar to that previously described with regard to the embodiment of FIG. 1, to compress packer element 250 into sealing position. Gradually increasing the pressure will rupture a rupture disk in external setting sleeve 255, thus providing an opening whereby fluid inside housing 202 may be pumped into the annulus about tool 202. The rupture disks provide a means for communicating with the annulus about the cementing tool after the setting sleeve has set the packer element. The operation of setting sleeve 255 is similar to the manner previously described with regard to the embodiment of FIG. 1.

It will be understood by those skilled in the art that certain variations and modifications may be made without departing from the spirit and scope of the invention as defined herein and in the appended claims.

What is claimed is:

1. A cementing tool apparatus comprising:

(a) an elongate tubular housing having a longitudinal passageway therethrough and having a cementing port and a longitudinal slot disposed through a wall thereof;

(b) an opening sleeve slidably received in the housing and movable relative to the housing between a first portion wherein the cementing port is closed by the opening sleeve and a second position wherein the cementing port is opened by the opening sleeve;

(c) a closure sleeve slidably received about the outer surface of the housing and movable relative to the housing between an open position wherein the cementing port is uncovered by the closure sleeve and a closed position wherein the cementing port is closed by the closure sleeve;

(d) an operating sleeve slidably received in the housing above the opening sleeve and slidable between first and second positions relative to the housing;

(e) mechanical interlocking means, extending through the slot and operably associated with both the operating sleeve and the closure sleeve, for mechanically transferring a closing force from the operating sleeve and thereby moving the closure sleeve to its closed position as the operating sleeve moves from its first position to its second position;

(f) a packer element slidably received about the outer surface of the housing; and (g) a means for setting the packer element for sealing an annular space below the cementing port.

2. The apparatus of claim 1 wherein the means for setting the packer element comprises:

an external setting sleeve, slidably received about the housing and movable relative to the housing between an initial position wherein the packer element is in a nonsealing position and a final position wherein the packer element is in its sealing position;

a bottom shoe fixedly attached to the housing and abutting the bottom of the packer element; and a means for communicating with an annular space about the cementing tool.

3. The apparatus of claim 2 wherein the means for communicating with an annular space about the cementing tool comprises a rupture disk.

4. The apparatus of claim 1 wherein said means for setting the packer element further comprises a locking means for locking the packer element in sealing position.

5. The apparatus of claim 1 further comprising a locking means for locking the closure sleeve in its closed position relative to the housing.

6. The apparatus of claim 2 wherein the closure sleeve is slidably received within the setting sleeve.

7. The apparatus of claim 3 wherein the means for setting the packer element further comprises a pressure equalizing valve.

8. The apparatus of claim 1 further comprising a plurality of sliding seals between the closure sleeve and the outer surface of the housing such that sliding seals are located above the cementing port and below the cementing port when closure sleeve is in its closed position.

9. The apparatus of claim 1 wherein the closure sleeve is longitudinally hydraulically balanced.

10. Method of operating a cementing tool comprising the steps of:

(a) positioning the cementing tool in a wellbore as part of a casing string, the cementing tool having:

a tubular housing having a cementing port and a longitudinal slot, both disposed through a wall thereof;

a closure sleeve slidably received about the housing;

an operating sleeve slidably received within the housing;

a packer element slidably received about the outer surface of the housing; and a means for setting the packer element for sealing an annular space below the cementing port.

(b) sealing the annulus space below the cementing port by setting the packer element;

(c) applying a moving force to the operating sleeve;

(d) mechanically transmitting the moving force from the operating sleeve to the closure sleeve, thereby moving the closure sleeve longitudinally to a sealing position over the cementing port.

11. The method of claim 10 wherein step (d) is further characterized in that the operating sleeve is fixedly connected to the closure sleeve so that there is no lost longitudinal motion of the operating sleeve relative to the closure sleeve.

12. The method of claim 10 wherein a plug means is used for applying a moving force to the operating sleeve.

13. The method of claim 10 further comprising locking the packer element in the sealing position.

14. The method of claim 10 further comprising locking the closure sleeve in the sealing position.

15. The method of claim 10 further comprising drilling the operating sleeve out of the housing and preventing the operating sleeve from rotating relative to the housing during the drilling.

* * * * *